US006052431A

United States Patent [19]

Onoguchi et al.

[11] Patent Number: 6,052,431

[45] Date of Patent: Apr. 18, 2000

[54] X-RAY CONVERGING MIRROR FOR AN ENERGY-DISPERSIVE FLUORESCENT X-RAY SYSTEM

[75] Inventors: Akira Onoguchi, Chofu; Kozo Kashihara, Miyanohigashi-machi, both of Japan

[73] Assignee: Horiba, Ltd., Kyoto, Japan

[21] Appl. No.: 09/092,199

[22] Filed: Jun. 5, 1998

[51] Int. Cl.[7] ..... G21K 1/06

[52] U.S. Cl. ..... 378/84; 378/43; 378/45; 378/145

[58] Field of Search ..... 378/84, 83, 82, 378/45, 43, 145

[56] References Cited

FOREIGN PATENT DOCUMENTS 262834 9/1987 European Pat. Off. .

62-274716 11/1987 Japan .

7167997 4/1995 Japan .

*Primary Examiner*—Craig E. Church

*Attorney, Agent, or Firm*—Price, Gess & Ubell

[57] ABSTRACT

An X-ray converging mirror that can be positioned adjacent an X-ray source for reflecting X-ray beams from the X-ray source includes an X-ray converging mirror having a reflecting surface of a cross-sectional profile expressed by a curve of the following equation:

$$x=y \tan \theta[1-ln(y/b)]$$

wherein x and y denote a coordinate system, θ is equal to or less than a Bragg critical angle of reflection for the X-ray beams, and b denotes a point on the y-axis when dx/dy is 0.

4 Claims, 4 Drawing Sheets

X-RAY CONVERGING MIRROR FOR AN ENERGY-DISPERSIVE FLUORESCENT X-RAY SYSTEM

BACKGROUND OF THE INVENTION

1. Field of the Invention

The present invention relates to an X-ray converging mirror located at the vicinity of the X-ray source for reflecting X-ray beams emitted from the X-ray source in an X-ray irradiation position direction in the X-ray irradiation device to provide an improved X-ray system, such as an X-ray analysis microscope.

2. Description of Related Art

In recent years, X-ray analysis microscopes have begun to be used in the analysis of biological tissues, such as plants and small animals as well as minerals or in the field of various analysis and quality control of semiconductor packages and electronic parts.

In an X-ray analysis microscope, it is necessary to irradiate microscopic portions of specimens with fine X-ray beams, which are important for analysis as a probe. Conventionally, fine X-ray beams are generated using a microfocus X-ray tube, such as an X-ray converging mirror for converging and focusing fine X-ray beams at an X-ray irradiation position, for example, ellipsoid of revolution type reflecting mirrors, as shown in Japanese Patent Publications No. Hei 4-6903, Hei 5-27840, and Hei 5-43080 have been used.

FIG. 3 schematically shows an ellipsoid of revolution type reflecting mirror where an X-ray source 4 is installed at a first focal point of the ellipsoid of revolution type reflecting mirror 30. A specimen 32 is installed at a second focal point of the mirror 30. Of the X-beams mitted from the X-ray source 31, those reflected on the reflecting surface of the mirror 30 are all converged to the specimen 32 surface.

However, because X-ray beams impinging in the vicinity of the central portion of the mirror 30, as in the case of X-ray beams shown with numeral 33, have a small incidence angle a with respect to the reflecting surface tangent 34 when an ellipsoid of revolution type mirror 30 is used for an X-ray converging mirror, the reflectivity at the reflecting surface is high and the ratio of the X-rays impinging in the specimen 32 (X-ray efficiency) is high. But in the case of the X-ray beams shown with numeral 35 impinging in the vicinity of the X-ray source 31 of the mirror 30, they have a large incidence angle β with respect to the reflecting surface tangent 36, and a problem exists in that the X-ray permeability at the reflection surface is high and the X-ray efficiency is low.

OBJECTS AND SUMMARY OF THE INVENTION

This invention is made with the above-mentioned matter taken into account, and it is the main object of this invention to provide an X-ray converging mirror that can reflect X-ray beams satisfactorily in the X-ray irradiation position direction in the vicinity of the X-ray source.

It is another object of the present invention to provide an improved X-ray analysis system, such as an energy-dispersive fluorescent X-ray analytical microscope, which includes a fluorescent X-ray detector, an X-ray guide tube, a sample stage, a transmitted X-ray detector, and appropriate processing systems to render a mapping image of the sample.

In order to achieve the above-mentioned objects, this invention relates to an improved X-ray converging mirror installed in the vicinity of the X-ray source to reflect X-ray beams emitted from the X-ray source in the X-ray irradiation position direction. The X-ray converging mirror is characterized by a cross-sectional profile of the mirror, which is a curve expressed by the following expression $$x=y \tan \theta[1-ln(y/b)]$$

θ is set to the critical angle or less, ln is the natural logarithm, and x, y, and b are positions on a coordinate system.

In the X-ray converging mirror of the above configuration, the reflectivity of X-ray beams in the vicinity of the X-ray source becomes high and the X-ray intensity also increases. Consequently, it is possible to obtain an X-ray converging mirror with an excellent X-ray efficiency.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

The following description is provided to enable any person skilled in the art to make and use the invention and sets forth the best modes contemplated by the inventors of carrying out their invention. Various modifications, however, will remain readily apparent to those skilled in the art, since the general principles of the present invention have been defined herein specifically to provide an X-ray converging mirror for an X-ray detecting system.

Figure 4:
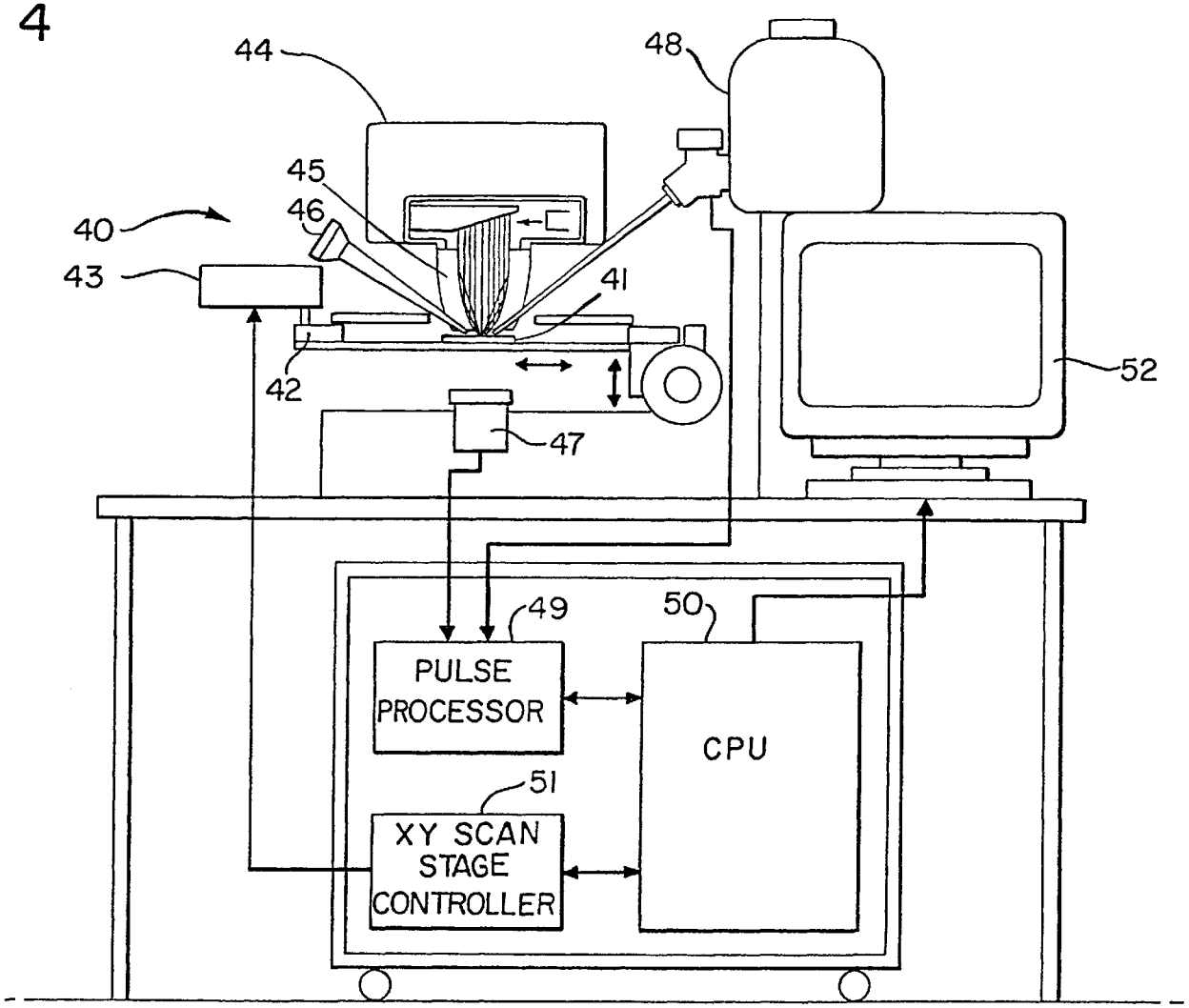
FIG. 4 is a schematic diagram of an X-ray analytical microscope system.

Referring to FIG. 4, a schematic embodiment of the present invention is disclosed in the form of an improved X-ray analytical microscope system 40. A sample 41 can be placed on a sample stage 42, which can be appropriately moved by a motor 43 to permit a scanning of the sample 41. An X-ray generator 44 generates X-rays which are focused onto the sample 41 by a microfocus X-ray tube or guide tube 45 has a shape that is paraboloid of revolution. An optical microscope 46 permits the operator to view the positioning and location of the sample. Below the sample stage is a transmission or scintillation X-ray detector 47, while above the sample stage is a fluorescent X-ray detector 48. The outputs from these respective detectors 47 and 48 are provided to a pulse processor circuit 49 and then transmitted to a CPU controller 50. The CPU controller 50 also provides direction to the XY scan stage controller 51. The CPU controller 50 can constitute one or more microprocessor systems to control the analysis and operation of the analytical microscope system. A detected output can be disclosed on a display 52.

The X-ray beams generated by the X-ray generator 44 are introduced into the guide tube 45 and, as a result of the shape of the guide tube, fine high intensity X-ray beams are generated that can irradiate the sample on the XY axis scanning stage 42. The resulting fluorescent X-rays that are generated can be measured by a silicon X-ray detector or fluorescent X-ray detector 48 that can be kept within a liquid nitrogen Dewar. The X-rays that are transmitted through the sample are measured by a scintillation detector 47. As a result of these measurement signals, the X-ray axis scanning signals can be reconstructed to make a mapping image of surface elements detected by the fluorescent X-rays and a mapping image of the internal structure of the sample as determined from transmitted X-rays. The guide tube can be moved so that spot diameters can vary, for example, from 10 $\mu$m to 100 $\mu$m to permit an optimum measurement suitable to the specific sample 41. As a result of the configuration of the X-ray guide tube or channel 8, the X-rays emitted from the X-ray generator 44 can be accurately positioned at a focal point coincident with the desired measurement point on the sample 41.

Referring now to the drawings, the embodiments of the improved X-ray converging mirror according to the invention will be described in detail.

Figure 1:
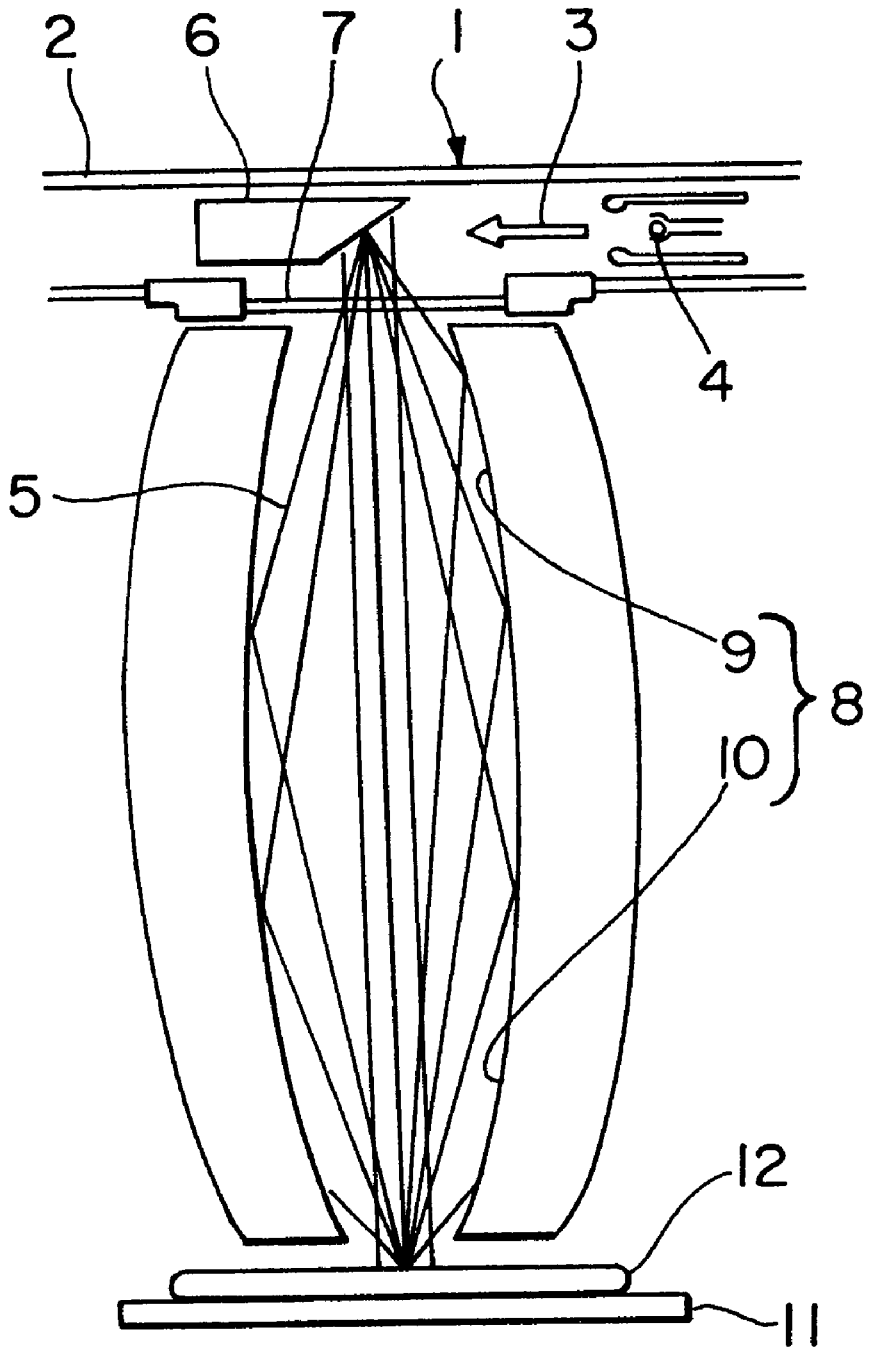
FIG. 1 schematically shows a principal portion of the X-ray analysis microscope with the X-ray converging mirror according to this invention assembled.

FIG. 1 shows a principal portion of the X-ray analysis microscope with the X-ray channel according to this invention. In FIG. 1, numeral 1 is a microfocus X-ray tube as an X-ray source, which comprises a filament 4 for generating electrons 3, and an X-ray target 6 for generating desired X-ray beams 5 by allowing the electrons 3 to collide against the target 6. The X-ray source 1 is housed in a container 2 held to a specified high vacuum. Numeral 7 is an X-ray transmission window comprising beryllium that allows the X-ray beams 5 generated at the X-ray target 6 to pass to the X-ray channel 8 side.

Numeral 8 is an X-ray channel that guides the X-ray beams emitted from the microfocus X-ray tube 1 to the X-ray irradiation position direction, and comprises material with a small amount of zinc added thereto, for example, silica glass. The X-ray channel 8 comprises an X-ray converging mirror 9 in the vicinity of the microfocus X-ray tube 1 and an X-ray channel portion 10 on the X-ray irradiation position side connected thereto.

The cross-sectional profile of the X-ray converging mirror can be expressed by the equation of $$x = y\tan\theta[1 - ln(y/b)] \quad \text{(I)}$$

where, b is a point on the y-axis when dx/dy is 0 and θ is equal to or less than the critical angle.

The X-ray channel portion 10 is equipped with a profile similar to that of the second focal point side of the ellipsoid of revolution type reflecting mirror 30 and is joined to the open side of the X-ray converging mirror 9 expressed by equation (1).

Numeral 11 is an XY-axis scanning stage provided on the other end side of the X-ray channel 8, and this XY-axis scanning stage 11 is held in such a manner that the X-ray beam from the X-ray tube 1 side converges to the surface of the specimen 12 placed on the stage 11, and in this embodiment, it is arranged in such a manner that the surface coincides with the focal point position of the X-ray channel portion 10.

Though not illustrated in FIG. 1, a scintillation detector for detecting the X-ray permeating the semiconductor detector or specimen 12 for detecting fluorescent X-rays is installed in such a manner to command the XY-axis scanning stage 11.

Figure 2:
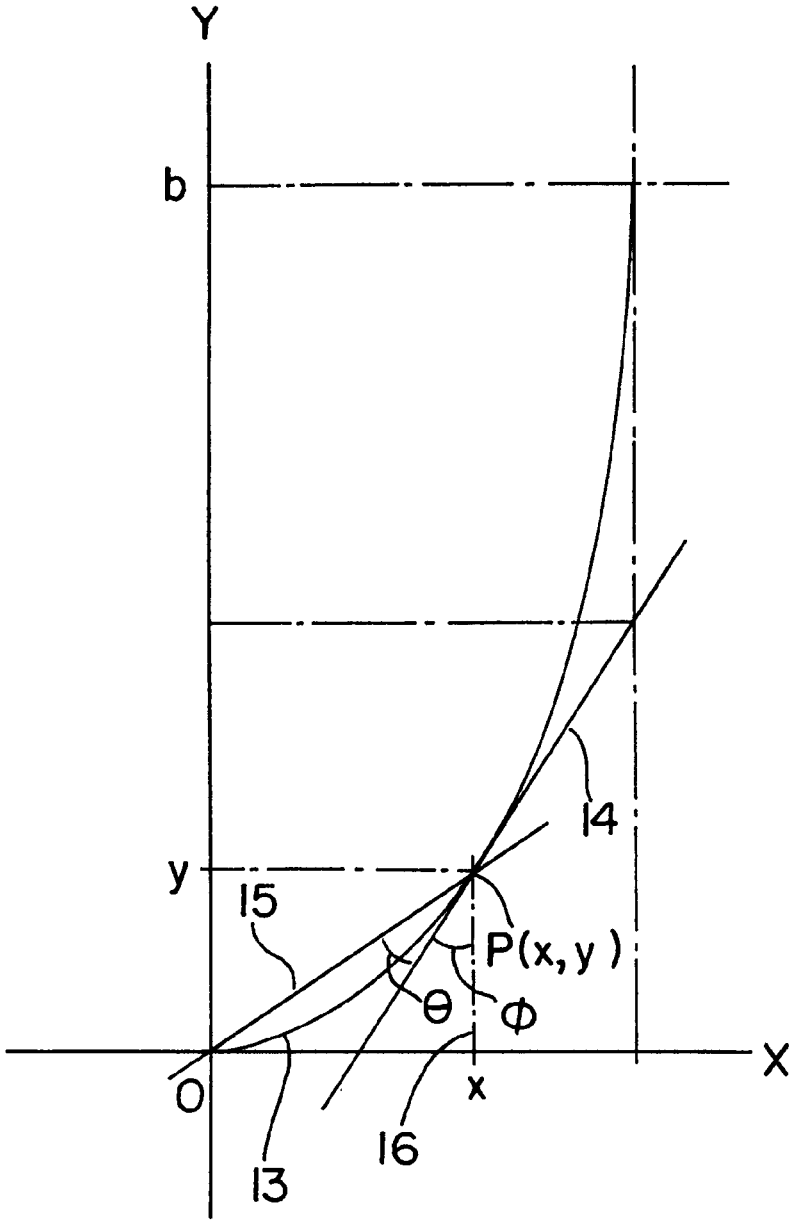
FIG. 2 is a diagram explaining the inner profile of the X-ray converging mirror.
Figure 3:
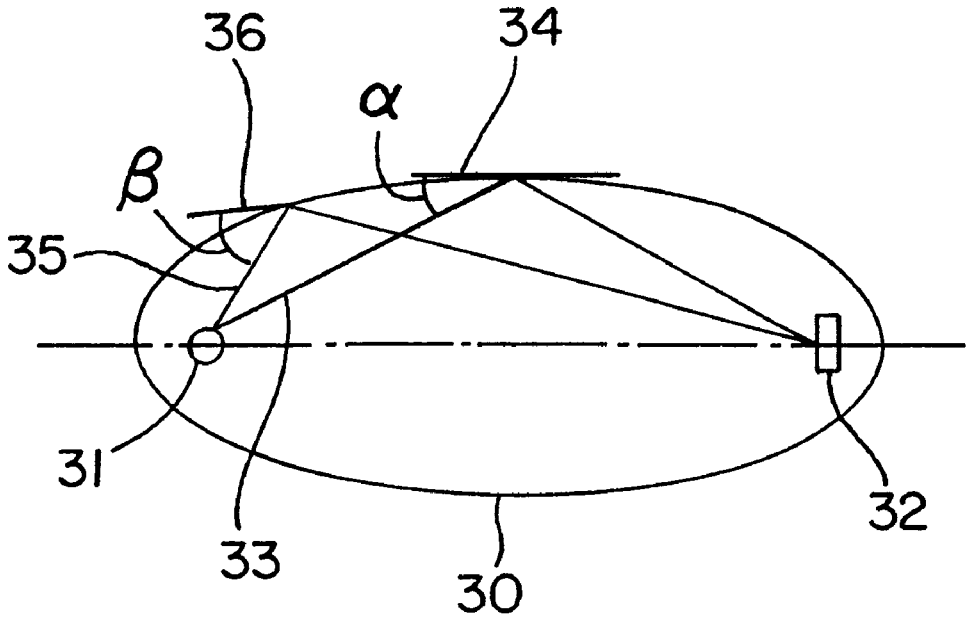
FIG. 3 is a diagram explaining a conventional technique.

Referring now to FIG. 2, description is made of the internal profile of the X-ray converging mirror 9 installed in the vicinity of the microfocus X-ray tube 1. As shown in FIG. 2 on X and Y planes, let the angle θ denote the angle made by a tangent 14 at point P (x, y) on curve 13 passing origin 0 and the line 15 connecting origin O and point P, and let ϕ denote the angle made by tangent 14 and perpendicular 16 to the y-axis at point P. Then we have $$x = \tan\theta \cdot y\tan\phi \quad (1)$$

Differentiate both sides of equation (1) results in:

$$cy/dx = \tan\theta + \tan\phi + y\cdot(1/\cos^2\phi)\cdot d\phi/dy \quad (2)$$

And for the gradient of tangent 14, we have $$dy/dx = \tan\phi \quad (3)$$

From equation (2) and equation (3), we obtain an equation as follows:

$$\tan\phi = \tan\theta + \tan\phi + y\cdot(1/\cos^2\phi)\cdot d\phi./dy \quad (4)$$

Consequently, $$\tan\theta + y\cdot(1/\cos^2\phi)\cdot d\phi/dy = o$$

$$\therefore d\phi/\cos^2\phi = \tan\theta\cdot dy/y \quad (5)$$

By integrating both sides of equation 5, this would result in:

$$\tan\phi = -\tan\theta\cdot lny + C \quad (6)$$

And if dx/dy=o, that is, ϕ=0 and y=b, we have $$C = \tan\theta\cdot lnb \quad (7)$$

Consequently, equation (6) is reduce to the following equation:

$$\tan\phi = -\tan\theta\cdot lny + \tan\theta\cdot lnb$$

$$= -\tan\theta(lny/lnb) \quad (8)$$

From equation (1) and equation (8), $$x = y\tan\theta[1 - ln(y/b)] \quad \text{(I)}$$

(where, b denotes one point on the y-axis when dx/dy is 0.)

The X-ray converging mirror 9 with a cross section given by equation (I) is arranged in such a manner that a microfocus X-ray tube 1 is located at the origin (position of reference symbol 0 in FIG. 2).

In an X-ray analysis microscope of the above configuration, the X-ray beams 5 generated at the microfocus X-ray tube 1 become fine X-ray beam of high brightness with a diameter less than 10 $\mu$m by passing through the X-ray channel 8. This fine X-ray beam 5 is applied to a specimen 12 placed on the XY-axis scanning stage 11, and the fluorescent X-ray generated from it is detected by a semiconductor detector and the X-ray that penetrates the specimen 12 is detected by a scintillation detector, respectively. And by correlating the signals of each detector into images using the XY-axis scanning signals, it is possible to obtain a mapping image of surface elements by fluorescent X-ray and also a mapping image of the internal construction of the sample by penetrating X-rays.

Because the cross-sectional profile of the X-ray converging mirror 9, located in the vicinity of the microfocus X-ray channel 1, is a curve expressed by the equation (I), the reflectivity of X-ray beam 5 in the vicinity of the microfocus X-ray tube 1 becomes high, and the X-ray intensity increases as much. Consequently, the X-ray efficiency of the X-ray converging mirror 9 improves and the measuring accuracy of the X-ray analysis microscope improves. In addition, the X-ray converging mirror 9 is small as compared to a conventional X-ray converging mirror, and it is possible to make the X-ray analysis microscope compact.

In the above-mentioned embodiment, an ellipsoid of revolution type reflecting mirror is used for the X-ray channel portion 10 joined to the X-ray converging mirror 9, but needless to say, it is possible to adopt a mirror of a profile conventionally used such as a paraboloid of revolution, etc. The X-ray converging mirror 9 of this invention is able to be applied to other X-ray irradiation equipment using X-ray tubes other than the illustrated X-ray analysis microscopes.

As described above, because the X-ray converging mirror of this invention is a curve whose cross-sectional profile is expressed by the following equation, $$x=y \tan \theta[1-ln(y/b)]$$

(where, b denotes a point on the y-axis when dx/dy is 0, and θ is equal or less than a Bragg critical angle of reflection.

it is possible to configure X-ray irradiation equipment with high measuring accuracy, good X-ray efficiency, and a compact optical system.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. An X-ray converging mirror that can be positioned adjacent an X-ray source for reflecting X-ray beams from the X-ray source, comprising:

an X-ray converging mirror having a reflecting surface of a cross-sectional profile expressed by a curve of the following equation:

$$x=y \tan \theta[1-ln(y/b)]$$

wherein x and y denote a coordinate system, θ is equal to or less than a critical angle of reflection for the X-ray beams, and b denotes a point on the y-axis when dx/dy is 0.

2. The X-ray converging mirror of claim 1, wherein the mirror is formed of silica glass with zinc.

3. An improved X-ray analytical microscope system comprising:

a source of X-rays;

a sample stage for supporting a sample;

an optical microscope for observing the sample;

a fluorescent X-ray detector operatively positioned to the sample stage;

a scintillation X-ray detector operatively positioned to the sample stage;

an X-ray converging mirror having a reflecting surface of a cross-sectional profile expressed by a curve of the following equation:

$$x=y \tan \theta[1-ln(y/b)]$$

wherein x and y denote a coordinate system, θ is equal to or less than critical angle of reflection for the X-ray beams, and b denotes a point on the y-axis when dx/dy is 0, whereby the X-ray converging mirror receives the X-rays form the source of X-rays and focuses the X-rays on the sample positioned on the sample stage; and means for providing an analysis of the detected X-rays.

4. An improved X-ray system having a source of X-rays, a sample stage for supporting a sample, an X-ray detector operatively positioned to the sample stage, the improvement comprising:

an X-ray converging mirror having a reflecting surface of a cross-sectional profile expressed by a curve of the following equation:

$$x=y \tan \theta[1-ln(y/b)]$$

wherein x and y denote a coordinate system, θ is equal to or less than critical angle of reflection for the X-ray beams, and b denotes a point on the y-axis when dx/dy is 0, whereby the X-ray converging mirror receives the X-rays form the source of X-rays and focuses the X-rays on the sample positioned on the sample stage; and means for providing an analysis of the detected X-rays.

* * * * *